US006367394B1

(12) United States Patent
Kaneko et al.

(10) Patent No.: US 6,367,394 B1
(45) Date of Patent: Apr. 9, 2002

(54) PULVERIZED FUEL COMBUSTION BURNER

(75) Inventors: Shouzo Kaneko; Tadashi Gengo; Kouichi Sakamoto; Takayoshi Isoda, all of Tokyo (JP)

(73) Assignee: Mitsubishi Heavy Industries, Tokyo (JP)

( * ) Notice: Subject to any disclaimer, the term of this patent is extended or adjusted under 35 U.S.C. 154(b) by 0 days.

(21) Appl. No.: 09/665,072

(22) Filed: Sep. 19, 2000

Related U.S. Application Data

(62) Division of application No. 09/052,025, filed on Mar. 31, 1998, now Pat. No. 6,145,449.

(30) Foreign Application Priority Data

Mar. 31, 1997 (JP) ..... 9-080206

(51) Int. Cl.[7] ..... F23L 1/10; B05B 15/08

(52) U.S. Cl. ..... 110/263; 110/261; 110/265; 239/432; 239/587.1; 239/587.5

(58) Field of Search ..... 110/261, 262, 110/263, 264, 265, 104 B; 239/432, 587.1, 587.5

(56) References Cited

U.S. PATENT DOCUMENTS

| | | | | |
|---|---|---|---|---|
| 2,895,435 A | * | 7/1959 | Bogot et al. | 110/28 |
| 4,252,069 A | | 2/1981 | McCartney | |
| 4,356,975 A | * | 11/1982 | Chadshay | 239/419.5 |
| 4,539,918 A | | 9/1985 | Beér et al. | |
| 4,611,543 A | | 9/1986 | Collette | |
| 4,930,430 A | | 6/1990 | Allen et al. | |
| 5,090,339 A | | 2/1992 | Okiura et al. | |
| 5,215,259 A | | 6/1993 | Wark | |

FOREIGN PATENT DOCUMENTS

| | | |
|---|---|---|
| GB | 2 272 755 | 5/1994 |
| JP | 1-217110 | 8/1989 |

(List continued on next page.)

*Primary Examiner*—Denise L. Esquivel
*Assistant Examiner*—K. B. Rinehart
(74) *Attorney, Agent, or Firm*—Wenderoth, Lind & Ponack, L.L.P.

(57) ABSTRACT

A pulverized fuel combustion burner and furnace arrangement has a plurality of air nozzles arranged on a side wall of the furnace for injecting a mixed flow of pulverized fuel and carrier air to establish a flame into the furnace. The plurality of nozzles includes a primary nozzle for injecting the mixed flow into the furnace and a secondary nozzle positioned around the primary nozzle for feeding combustion auxiliary air around the primary nozzle. A pulverized fuel supply pipe feeds the mixed flow to the primary nozzle. The primary nozzle and the pulverized fuel supply pipe are joined at a jointed portion at which the primary nozzle can be pivoted to change a direction for injecting the mixed flow into the furnace. The pulverized fuel supply pipe extends through a windbox, the windbox forming a combustion auxiliary air supply passage around the pulverized fuel supply pipe. A rich/lean flow separator is disposed in a middle portion of the pulverized fuel supply pipe spaced from opposite inner walls of the pulverized fuel supply pipe such that when the mixed flow flows around the rich/lean flow separator, a rich/lean flow concentration distribution is established in which a fuel-rich flow is created at an outer part inside of the pulverized fuel supply pipe and adjacent to the opposite inner walls and a fuel-lean flow is created at an inner part inside of the rich flow and along a center line of the pulverized fuel supply pipe. Flow straightening plates are disposed and positioned in the primary nozzle and the pulverized fuel supply pipe downstream of the rich/lean flow separator so as to maintain the rich/lean flow concentration distribution established by the rich/lean flow separator to the exit of the primary nozzle.

2 Claims, 6 Drawing Sheets

U.S. PATENT DOCUMENTS 5,392,720 A * 2/1995 Briggs et al. ..... 110/264
5,483,906 A 1/1996 Hufton
5,535,686 A 7/1996 Chung
5,605,103 A 2/1997 LaRue
5,829,367 A * 11/1998 Ohta et al. ..... 110/261
5,842,426 A 12/1998 Ohta et al.
6,024,030 A * 2/2000 Okatomo et al. ..... 110/261
6,053,118 A * 4/2000 Okatomo et al. ..... 110/261
6,089,171 A * 7/2000 Fong et al. ..... 110/263

* cited by examiner

PULVERIZED FUEL COMBUSTION BURNER

This is a divisional of U.S. patent application Ser. No. 09/052,025, filed on Mar. 31, 1998, now U.S. Pat. No. 6,145,449.

BACKGROUND OF THE INVENTION

1. Field of the Invention

The present invention relates to a pulverized fuel combustion burner to be applied to a boiler of a thermal power plant or chemical plant, a furnace of a chemical plant or the like.

2. Related Art

A technique of the prior art will be described with reference to FIGS. 5(*a*)–(*c*). FIGS. 5(*a*) to 5(*c*) are side sections showing a construction of a pulverized fuel combustion burner schematically. FIGS. 5(*a*), 5(*b*) and 5(*c*) show the cases, respectively, in which a mixed flow of a pulverized fuel and carrier air is injected horizontally, in which the mixed flow is injected upwardly, and in which the mixed flow is injected downwardly.

Reference numeral 1 designates a primary air nozzle, (also more simply referred to as the 'primary nozzle') and numeral 2 designates a secondary air nozzle (also more simply referred to as the 'secondary nozzle') arranged outside of the primary air nozzle 1. Numeral 3 designates a pulverized fuel supply pipe, and numeral 4 designates a combustion auxiliary fuel supply passage which is defined by the pulverized fuel supply pipe 3 and a windbox 5. The pulverized fuel supply pipe 3 communicates with the primary air nozzle 1, and its terminal end, and the combustion auxiliary air supply passage 4 communicates with the secondary air nozzle 2.

Reference numeral 10 designates a rich/lean flow separator which is arranged in the pulverized fuel supply pipe 3 so that a mixed flow 7 of the pulverized fuel and the carrier air, flowing through the pulverized fuel supply pipe 3, may impinge upon the rich/lean flow separator 10 and may be separated by the action of centrifugal force into a relatively rich flow 8 (as indicated by solid lines) to flow along the outer side and a lean flow 9 (as indicated by broken lines) to flow along the inner side.

Here, reference numeral 12 designates a clearance which is established between the furnace side end portion of the windbox 5 and the windbox side end portion of the secondary air nozzle 2 when the secondary air nozzle 2 is directed upward, as shown in FIG. 5(*b*), or downward, as shown in FIG. 5(*c*), by θ degrees.

Under ordinary operation, the mixed flow 7 of the pulverized fuel and the carrier air is guided through the pulverized fuel supply pipe 3 into the primary air nozzle 1 so that it is injected into the furnace. On the other hand, the combustion auxiliary air is guided through the combustion auxiliary air supply passage 4 into the secondary air nozzle 2 so that it is injected into the furnace.

In order to satisfy performances criteria for a low Nox combustion required from a combustion aspect, both the relatively rich and lean flows 8 and 9 of the pulverized fuel, as separated after the mixed flow 7 is separated by the action of the rich/lean flow separator 10, have to maintain a proper concentration distribution on a furnace side exit plane of the primary air nozzle 1.

Moreover, the combustion auxiliary air has to be injected as wholly as possible through the secondary air nozzle 2 into the furnace to thereby make an effective contribution to the combustion.

FIG. 5(*a*) shows the state in which the mixed flow 7 and the combustion auxiliary air are injected horizontally into the furnace. In this burner of the prior art, the injection direction of the mixed flow 7 and the combustion auxiliary air into the furnace can be changed upward or downward by directing the primary air nozzle 1 and the secondary air nozzle 2 upward or downward, respectively, as shown in FIGS. 5(*b*) and 5(*c*). As a result, the position of the flame to be maintained in the furnace can be moved upward or downward in the furnace to thereby adjust the gas temperature distribution in the furnace and the gas temperature at the furnace exit plane.

In the burner of the prior art thus far described, the mixed flow 7 of the pulverized fuel and carrier air can achieve the proper concentration distribution in the furnace side exit plane of the primary air nozzle 1 when it is injected horizontally into the furnace, as shown in FIG. 5(*a*). When the primary air nozzle 1 is directed upward or downward, respectively, as shown in FIG. 5(*b*) or 5(*c*), on the other hand, the relatively rich flow 8 of the pulverized fuel is biased, causing a problem in that the mixed flow 7 cannot establish the proper rich/lean distribution in the furnace side exit plane of the primary air nozzle 1 like the state shown in FIG. 5(*a*).

Moreover, the combustion auxiliary air has to pass as wholly as possible through the secondary air nozzle 2. When the secondary air nozzle 2 is directed upward or downward, however, the clearance 12 is established, as shown in FIGS. 5(*b*) and 5(*c*), between the furnace side end portion of the windbox 5 and the windbox side end portion of the secondary air nozzle 2. As a result, a portion of the combustion auxiliary air bypasses the secondary air nozzle 2 from that clearance 12 and leaks into the furnace, causing a problem in that the combustion auxiliary air does not make an effective contribution to combustion.

SUMMARY OF THE INVENTION

The invention contemplates resolving the problems of the prior art and has an object of providing a pulverized fuel combustion burner which can maintain the concentration distribution of the pulverized fuel and can eliminate the leakage of the combustion auxiliary air.

In order to achieve the above-specified object, according to an aspect of the invention, there is provided a pulverized fuel combustion burner comprising a plurality of air nozzles arranged on a side wall of a furnace for injecting a mixed flow of a pulverized fuel and carrier air to establish a flame. The burner includes a primary air nozzle having a variable direction to inject the mixed flow into the furnace, a secondary air nozzle for feeding combustion auxiliary air around the primary air nozzle, a pulverized fuel supply for feeding the mixed flow to the primary air nozzle and a windbox having the pulverized fuel supply pipe extend therethrough for forming a combustion auxiliary air supply passage around the pulverized fuel supply pipe. The windbox is constructed by arranging unit windboxes in a separate or jointed relation with each other. Each unit windbox has at least one pulverized fuel supply pipe and one combustion auxiliary air supply passage. A rich/lean flow separator is disposed at or near a jointed portion between the primary air nozzle and the pulverized fuel supply pipe. The rich/lean flow separator is able to change its direction in response to or independently of a change in an injection direction of the primary air nozzle.

Specifically, the rich/lean flow separator is arranged at or near the jointed portion between the primary air nozzle and the pulverized fuel supply pipe, and the rich/lean flow separator is able to change its direction in response to or independently of the change in the injection direction of the primary air nozzle. Thus, when the primary air nozzle changes its injection direction upward or downward, for example, the rich/lean flow separator follows the direction change so that the mixed air of the rich and lean flows separated thereby is injected without any bias and in accordance with the direction of the primary air nozzle.

According to another aspect of the invention, there is provided a pulverized fuel combustion burner further comprising another rich/lean air separator disposed upstream of the first rich/lean flow separator. Specifically, upstream of the rich/lean flow separator disposed at or near the jointed portion between the primary air nozzle and the pulverized fuel supply pipe, there is disposed another rich/lean flow separator. Thus, the rich/lean flow separation is made at first by the rich/lean flow separator positioned upstream, and then is further made by taking over the separation effect at or near the jointed portion which is near the injection port between the primary air nozzle and the pulverized fuel supply pipe, while still following direction changes in accordance with upward or downward movement of the primary air nozzle.

According to a further aspect of the invention, there is provided a pulverized fuel combustion burner comprising a plurality of air nozzles arranged on a side wall of a furnace for injecting a mixed flow of a pulverized fuel and carrier air to establish a flame. The air nozzles include a primary air nozzle having a variable direction to inject the mixed flow into the furnace, a secondary air nozzle for feeding combustion auxiliary air to around the primary air nozzle, a pulverized fuel supply pipe for feeding the mixed flow to the primary air nozzle and a windbox receiving the pulverized fuel supply pipe therethrough for forming a combustion auxiliary air supply passage around the pulverized fuel supply pipe. The windbox is being constructed by arranging unit windboxes in a separated or jointed relation with respect to each other. Each unit windbox has at least one pulverized fuel supply pipe and one combustion auxiliary air supply passage. A rich/lean flow separator is disposed in the pulverized fuel supply pipe and a flow straightener or a straightening plate is disposed in at least one of the primary air nozzle and the pulverized fuel supply pipe for maintaining a concentration distribution, as established by the rich/lean flow separator up to an exit of the primary air nozzle.

That is, subsequent to the rich/lean flow separator disposed in the pulverized fuel supply pipe, more specifically, a flow straightener or a straightening plate is disposed in at least one of the primary air nozzle and the pulverized fuel supply pipe. As a result, the effect of the rich/lean flow separator is taken over by the flow straightener or the straightening plate so that the rich flow and the lean flow are carried in a separated state and injected through the primary air nozzle into the furnace.

According to a further aspect of the invention, there is provided a pulverized fuel combustion burner further comprising a combustion auxiliary air flow straightener disposed in the windbox for guiding the combustion auxiliary air into an entrance of the secondary air nozzle. Specifically, the leakage of combustion auxiliary air at the entrance of the secondary air nozzle can be drastically prevented not only by devising the primary air nozzle for guiding the mixed flow of the pulverized fuel and the carrier air preferably but also by guiding the combustion auxiliary air to the entrance of the secondary air nozzle with the combustion auxiliary air flow straightener disposed in the windbox.

According to a further aspect of the invention, there is provided a pulverized fuel combustion burner wherein the primary air nozzle is disposed at a corner portion of the side wall of the furnace. Specifically, the burner is devised to separate the mixed flow of the pulverized fuel and the carrier air into the rich flow and the lean flow with the pulverized fuel supply pipe and the primary air nozzle and to maintain the separation effect. The burner is arranged at the corner portion of the furnace side wall so that a preferable injection may be effected from the corner portion into the furnace.

According to a further aspect of the invention, there is provided a pulverized fuel combustion burner wherein the windbox comprises a plurality of unit windboxes, each having a square front section and each having at least one pulverized fuel supply pipe and one combustion auxiliary air supply passage. The unit windboxes are arranged in a separated or jointed relation with respect to each other, and the unit windbox has an upward and downward directional length of one and a half (1.5) times or less of its lateral directional length.

Specifically, the unit windbox is constructed by housing the primary air nozzle, which is devised to separate the mixed flow of the pulverized fuel and the carrier air with the pulverized fuel supply pipe and the primary air nozzle and to keep the separation effect, and the secondary air nozzle which prevents the leakage of the combustion auxiliary air at its entrance. The unit windbox has an upward and downward directional length of one and a half (1.5) times or less its lateral directional length, thereby making the entire construction compact without lowering the performance.

BRIEF DESCRIPTION OF THE DRAWINGS

Of FIGS. 1(*a*), 1(*b*) and 1(*c*) schematically showing a pulverized fuel combustion burner according to a first embodiment of the Invention: FIG. 1(*b*) is an explanatory diagram showing a case in which the mixed flow is injected upward; and FIG. 1(*c*) is an explanatory diagram showing a case in which the mixed flow is injected downward;

Of FIGS. 2(*a*), 2(*b*) and 2(*c*) schematically showing a pulverized fuel combustion burner according to a second embodiment of the Invention: FIG. 2(*b*) is an explanatory diagram showing a case in which the mixed flow is injected upward; and FIG. 2(*c*) is an explanatory diagram showing a case in which the mixed flow is injected downward;

Of FIGS. 3(*a*), 3(*b*), 3(*c*) and 3(*d*) schematically showing a pulverized fuel combustion burner according to a third embodiment of the Invention: FIG. 3(*b*) is an explanatory diagram showing a case in which the mixed flow is injected upward; FIG. 3(*c*) is an explanatory diagram showing a case in which the mixed flow is injected downward; and FIG. 3(*d*) is a cross-sectional view of a pulverized fuel supply pipe taken along line 3*d*—3*d*of FIG. 3(*a*);

Of FIGS. 4(*a*), 4(*b*) and 4(*c*) schematically showing a pulverized fuel combustion burner according to a fourth embodiment of the Invention.

4(*b*) is an explanatory diagram showing a case in which the mixed flow is injected upward; and FIG. 4(*c*) is an explanatory diagram showing a case in which the mixed flow is injected downward; and Of FIGS. 5(*a*), 5(*b*) and 5(*c*) schematically showing a pulverized fuel combustion burner of the prior art: FIG. 5(*b*) is an explanatory diagram showing a case in which the mixed flow is injected upward; and FIG. 5(*c*) is an explanatory diagram showing a case in which the mixed flow is injected downward.

DESCRIPTION OF THE PREFERRED EMBODIMENTS

Figure 1A:
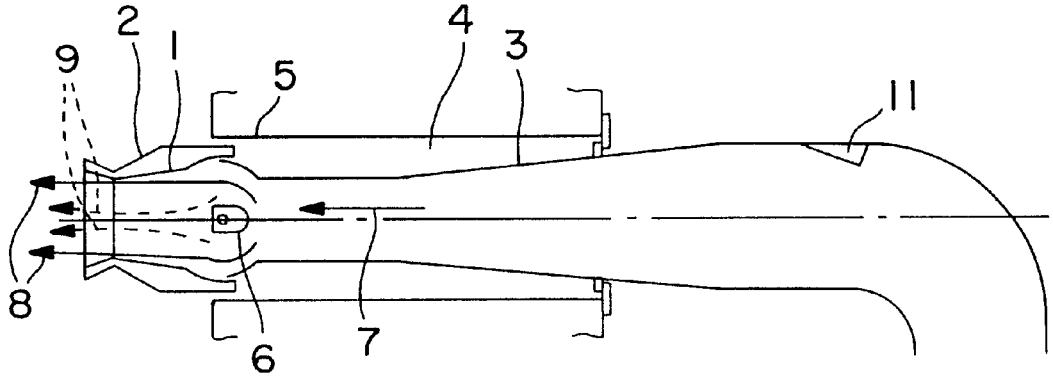
FIG. 1(*a*) is an explanatory diagram showing a case in which a mixed flow of a pulverized fuel and carrier air is injected horizontally.
Figure 1B:
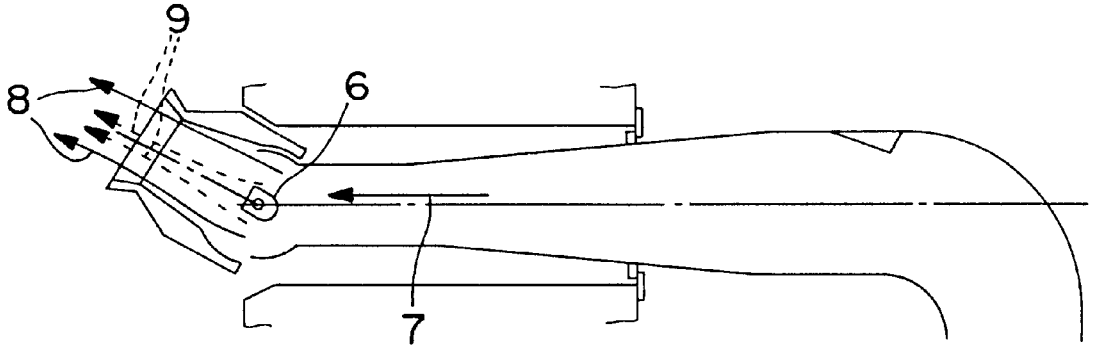
Figure 1C:
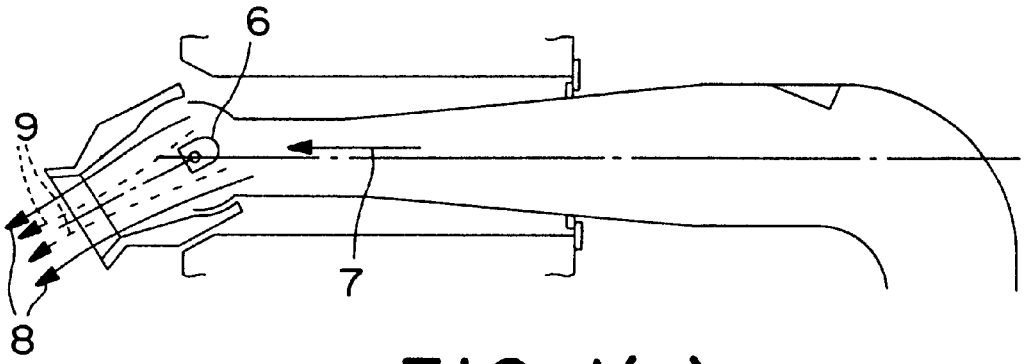

One embodiment of the present invention will be described with reference to FIGS. 1(*a*) to 1(*c*). FIGS. 1(*a*) to 1(*c*) are side sections showing a construction of a pulverized fuel combustion burner schematically. FIGS. 1(*a*), 1(*b*) and 1(*c*) show the cases, respectively, in which a mixed flow of a pulverized fuel and carrier air is injected horizontally, in which the mixed flow is injected upwardly, and in which the mixed flow is injected downwardly. Here, portions identical to those of the prior art are designated by common reference numerals, and overlapping description has been omitted.

In this embodiment, at the jointed portion between the primary air nozzle 1 (also called a primary nozzle) and the pulverized fuel supply pipe 3, the rich/lean flow separator 6 is connected to the primary air nozzle 1 by a suitable joint mechanism so that its direction may be changed as the primary air nozzle 1 changes its injection direction.

Incidentally, the rich/lean flow separator 6 can also have a structure that is separate from the primary air nozzle 1 so that it can act by itself and can detect the motion of the primary air nozzle 1 to change its direction according to the motion detected.

Reference numeral 11 designates a dispersing device arranged at an outer side at a bent portion where the pulverized fuel supply pipe 3 is curved upstream. A rich mixture flow, having a tendency to diverge by centrifugal force, may then impinge upon the dispersing device and to be homogeneously dispersed in the pulverized fuel supply pipe 3.

In this embodiment, the rich/lean flow separator 6 is constructed to follow the change in the direction of the primary air nozzle 1, as described above. While the primary air nozzle 1 is directed horizontally, as shown in FIG. 1(*a*), the rich/lean flow separator 6 is also directed horizontally. When the primary air nozzle 1 is directed upward, as shown in FIG. 1(*b*), the rich/lean flow separator 6 is accordingly directed upward. When the primary air nozzle 1 is directed downward, as shown in FIG. 1(*c*), the rich/lean flow separator 6 is accordingly directed downward. Thus, the rich/lean flow separator 6 acts to introduce the flow of the mixed flow 7 in the same direction as that of the injection into the furnace by the primary air nozzle 1.

Thus, according to this embodiment, both the rich flow 8 and the lean flow 9 of the pulverized fuel, prepared by the rich/lean flow separator 6, can establish a flow which maintains a concentration distribution equivalent to that of the case in which the mixed flow 7 is being injected horizontally. Even if the direction of the primary air nozzle 1 for injecting the mixed flow 7 changes from the horizontal to the upward or downward directions, the concentration distribution, as maintained for the combustion efficiency of the fuel, can be maintained without establishing any biased flow in the exit plane of the primary air nozzle 1.

Figure 6:
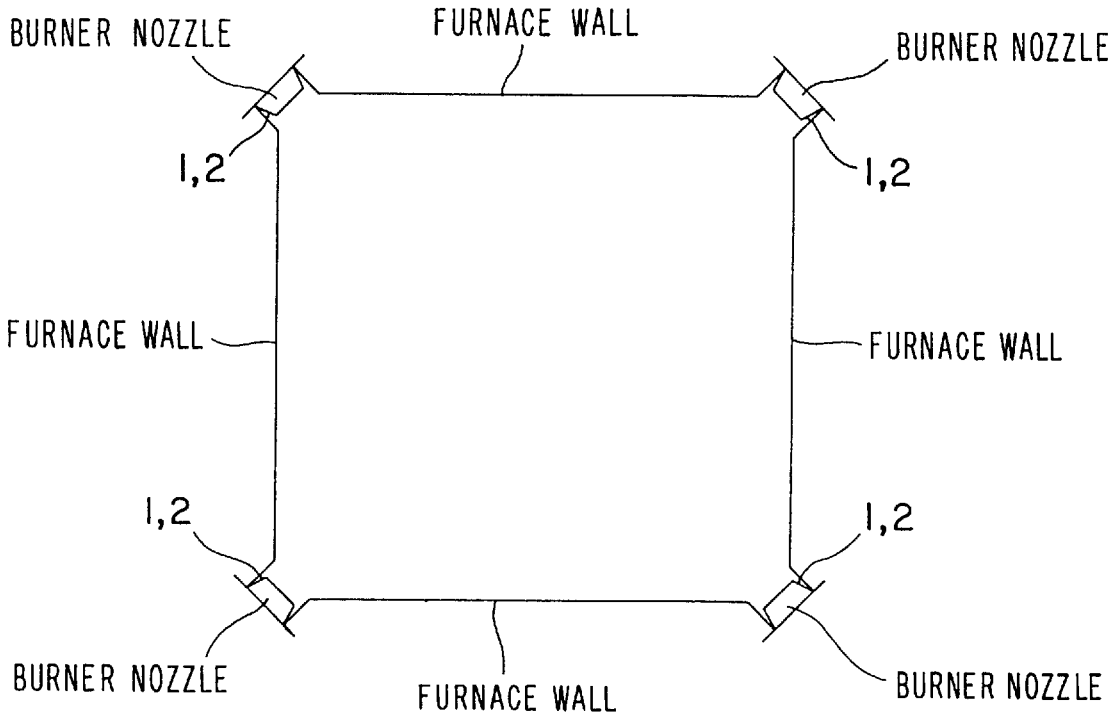
FIG. 6 is an explanatory view showing an example of an arrangement of a pulverized fuel combustion burner in a furnace with respect to each of the embodiments according to the present invention.

Here, the primary air nozzle (burner nozzle) thus constructed is arranged at each corner portion of the furnace side wall (furnace wall), as schematically shown in FIG. 6, so that the mixed flow of the pulverized fuel, as separated into rich and lean, and the carrier air may be efficiently injected from the corner portion into the furnace.

Figure 7:
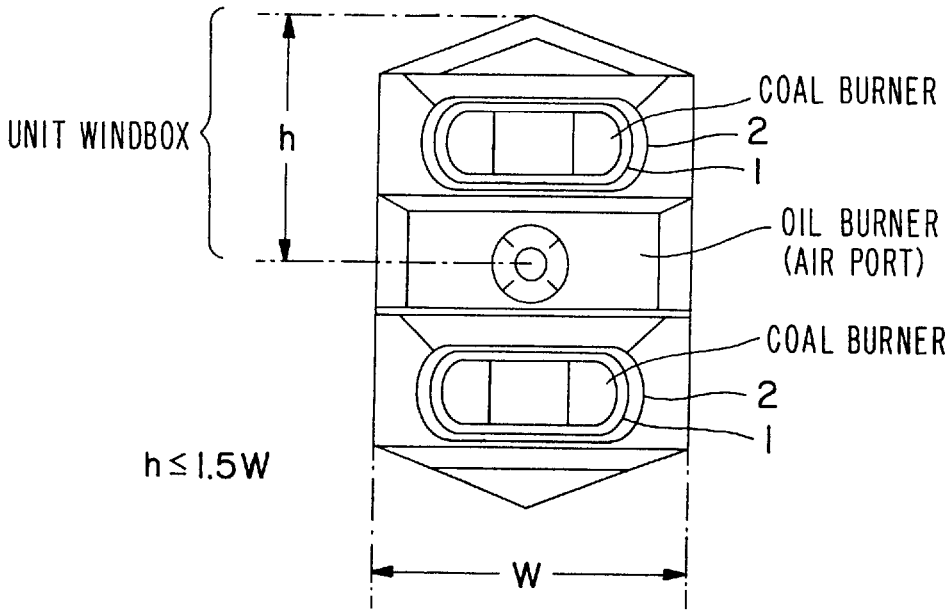
FIG. 7 is an explanatory view showing an outline of a unit windbox formed by the pulverized fuel combustion burner with respect to each of the embodiments according to the present invention.

Also, as shown in FIG. 7, a unit windbox having a square front section is made of at least one pulverized fuel supply pipe and one combustion auxiliary air supply pipe. A plurality of these unit windboxes are arranged either separately or by jointing them. This construction is made compact as a whole by making the upward and downward directional length of the unit windbox one and a half (1.5) times or less of the lateral directional length of the windbox. It is to be noted that, in FIG. 7, a coal burner which is constructed by the pulverized fuel supply pipe, the combustion auxiliary air supply passage, etc. and an oil burner are shown, but when no oil fuel is supplied, the oil burner may be used as an air port for supplying auxiliary air.

Figure 2A:
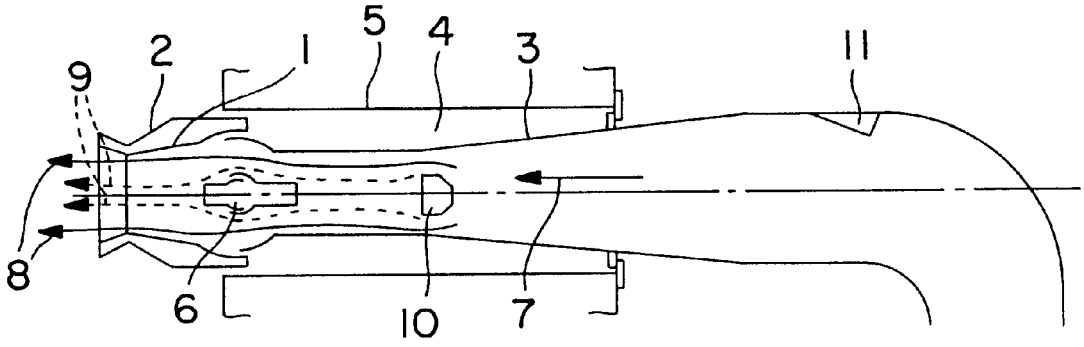
FIG. 2(*a*) is an explanatory diagram showing a case in which a mixed flow of a pulverized fuel and carrier air is injected horizontally.
Figure 2B:
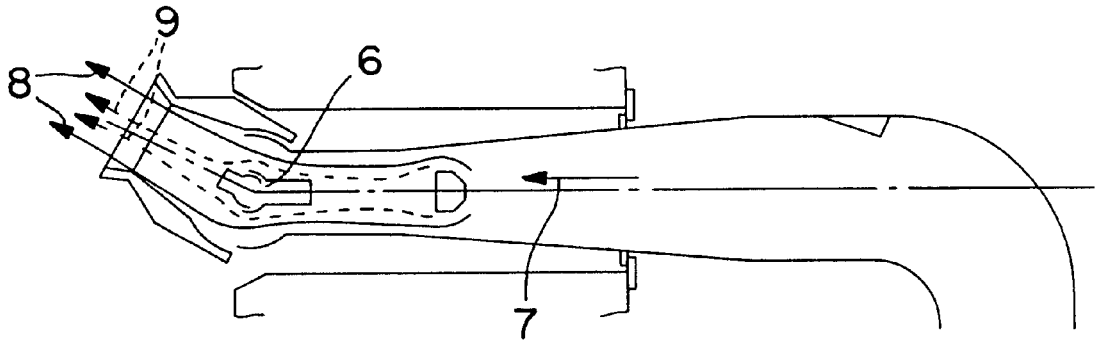
Figure 2C:
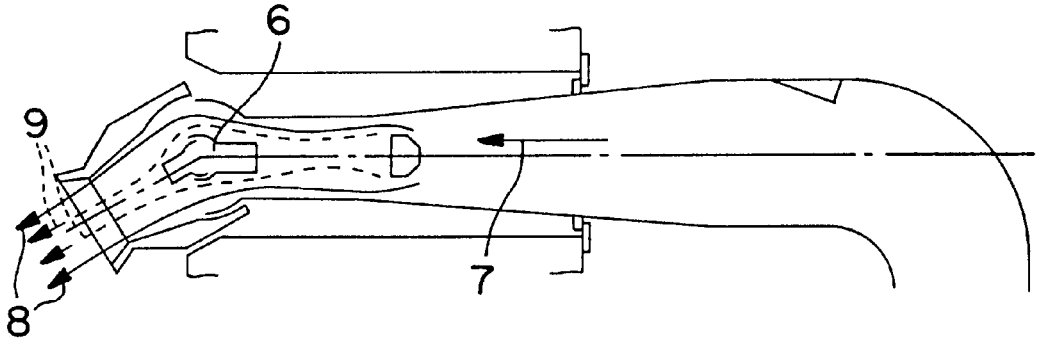
Figure 3A:
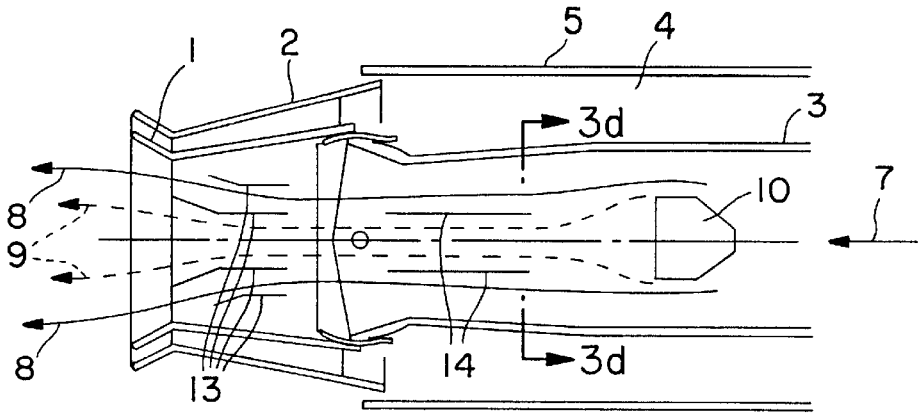
FIG. 3(*a*) is an explanatory diagram showing a case in which a mixed flow of a pulverized fuel and carrier air is injected horizontally.
Figure 3B:
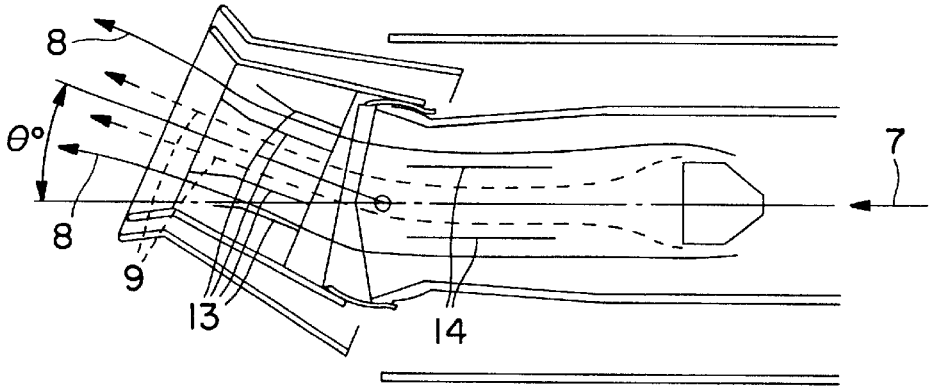
Figure 3C:
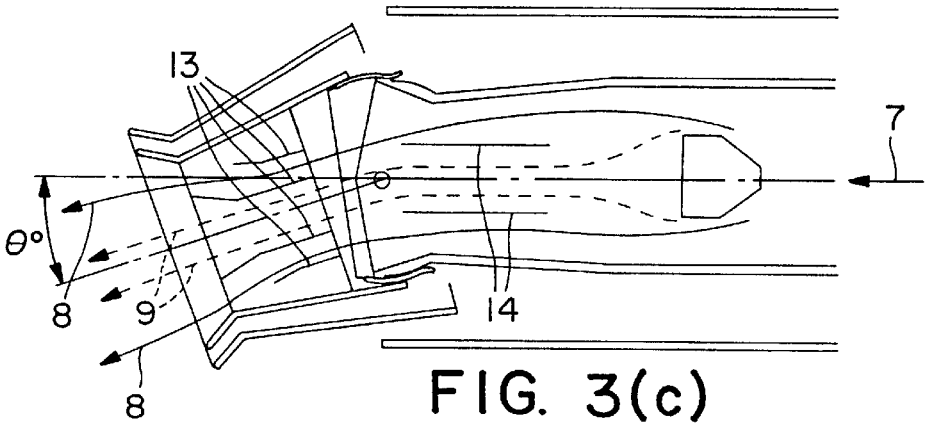
Figure 3D:
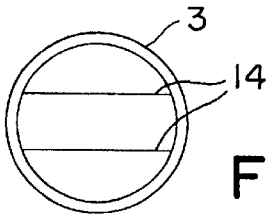

A second embodiment of the present invention will be described with reference to FIGS. 2(*a*) to 2(*c*). Like FIGS. 1(*a*) to 1(*c*) showing the first embodiment, FIGS. 2(*a*) to 2(*c*) are side sections showing a construction of a pulverized fuel combustion burner schematically. FIGS. 2(*a*), 2(*b*) and 2(*c*) show the cases, respectively, in which a mixed flow of a pulverized fuel and carrier air is injected horizontally, in which the mixed flow is injected upward, and in which the mixed flow is injected downward. Here, the portions identical to those of the prior art or the first embodiment are designated by common reference numerals, and overlapping description will be omitted.

In this embodiment, another rich/lean flow separator 10 is arranged upstream of the rich/lean flow separator 6 which is disposed at the jointed portion between the primary air nozzle 1 and the pulverized fuel supply pipe 3.

Of these rich/lean flow separators 6 and 10, the downstream separator 6, as disposed at the jointed portion between the primary air nozzle 1 and the pulverized fuel supply pipe 3, is of a variable type so as to act according to the action of the primary air nozzle 1, as in the first embodiment. That is, the flow direction can be changed so that the relatively rich and lean flows 8 and 9 may be established in the same direction in which the pulverized fuel is injected into the furnace. On the other hand, the other rich/lean flow separator 10, arranged upstream, may be either of a fixed type, or of a variable type in which it is not especially restrained by the action of the primary air nozzle 1.

In this embodiment, the mixed flow 7 is separated at first into the rich and lean flows by the upstream rich/lean flow separator 10, and is then guided in the downstream rich/lean flow separator 6 and the primary air nozzle 1. As in the first embodiment, the downstream rich/lean flow separator 6 is constructed to follow the change in the direction of the primary air nozzle 1, as described above. While the primary air nozzle 1 is directed horizontally, as shown in FIG. 2(*a*), the rich/lean flow separator 6 is also directed horizontally.

When the primary air nozzle 1 is directed upward, as shown in FIG. 2(*b*), the rich/lean flow separator 6 is accordingly directed upward. When the primary air nozzle is directed downward, as shown in FIG. 2(*c*), the rich/lean flow separator 6 is accordingly directed downward. Thus the rich/lean flow separator 6 acts to introduce the flow of the mixed flow 7 in the same direction as that of the injection into the furnace by the primary air nozzle 1.

By this action, the pulverized fuel, as prepared by the rich/lean flow separators 6 and 10, is able to establish flows that maintain a concentration distribution equivalent to that of the case in which both the rich flow 8 and the lean flow 9 are injected horizontally, as shown in FIG. 2(*a*).

Even if the direction for the primary air nozzle 1 to inject the mixed flow 7 changes from the horizontal to the upward or downward directions, with the additional action of the rich/lean flow separator 10, the concentration distribution, as required for the combustion efficiency of the fuel, can be maintained in the exit plane of the primary air nozzle 1.

Further, a third embodiment of the present invention will be described with reference to FIGS. 3(*a*) to 3(*d*). Like the first and second embodiments, FIGS. 3(*a*) to 3(*c*) are side sections showing a construction of a pulverized fuel combustion burner schematically. FIGS. 3(*a*), 3(*b*) and 3(*c*) show the cases, respectively, in which a mixed flow of a pulverized fuel and carrier air is injected horizontally, in which the mixed flow is injected upward, and in which the mixed flow is injected downward. Here, the portions identical to those of the prior art or the first and second embodiments are designated by common reference numerals, and overlapping description has been omitted This embodiment is provided with a first straightening plate 13 which is disposed in the primary air nozzle 1 and changes its direction in accordance with the change in the direction of the primary air nozzle 1, and a second straightening plate 14 which is disposed in the pulverized fuel supply pipe 3 downstream of the rich/lean flow separator 10.

In this embodiment, the mixed flow 7 of the pulverized fuel and the carrier air is injected horizontally from the primary air nozzle 1 or primary nozzle, as shown in FIG. 3(*a*). The primary air nozzle 1 can change its direction to inject the mixed flow 7 upward or downward, as shown in FIGS. 3(*b*) or 3(*c*).

Before this injection, the mixed flow 7 is separated into rich and lean flows by the rich/lean flow separator 10, and is then introduced into the primary air nozzle 1.

First of all, as shown in FIG. 3(*a*), the second straightening plate 14 in the pulverized fuel supply pipe 3 acts to maintain the concentration distribution, as determined by the rich flow 8 and the lean flow 9 of the pulverized fuel, at a stage before the rich flow 8 and the lean flow 9 reach the primary air nozzle 1. The first straightening plate 13 in the primary air nozzle 1 acts to direct the rich flow 8 of the pulverized fuel toward the inner face of the primary air nozzle 1.

When the primary air nozzle 1 is directed upward or downward by θ degrees, as shown in FIGS. 3(*b*) or 3(*c*), the pulverized fuel is able to maintain the concentration distribution of the rich flow 8 and the lean flow 9 as established by the rich/lean flow separator 10 due to the straightening actions of the second straightening plate 14 in the pulverized fuel supply pipe 3 and the first straightening plate 13 in the primary air nozzle 1.

By the actions of these first and second straightening plates 13 and 14, the rich flow 8 and the lean flow 9 of the pulverized fuel are able to establish flows which maintain a concentration distribution equivalent to that of the case in which the mixed flow 7 is injected horizontally, as shown in FIG. 3(*a*). Even if the direction of the primary air nozzle 1 for injecting the mixed flow 7 changes from the horizontal to the upward or downward directions, with the additional action of the rich/lean flow separator 10, the concentration distribution, as required for the combustion efficiency of the fuel, can be maintained in the exit plane of the primary air nozzle 1.

In the embodiment of FIGS. 3(*a*)–3(*d*), the flow straightening plates 14 form a means, disposed in both the primary nozzle 1 and the pulverized fuel supply pipe 3 downstream of the rich/lean flow separator 10, for maintaining the rich/lean flow concentration distribution established by the rich/lean flow separator to the exit of the primary nozzle 1 even when the primary nozzle is pivoted and the direction for injecting the mixed flow changes as shown in FIGS. 3(*b*) and 3(*c*). FIG. 3(*d*) shows the straightening plates 14 in the pulverized fuel supply pipe 3 extending from one side to the other. As can be seen from their manner of illustration in FIGS. 3(*a*)–3(*c*), this is also the case with the flow straightening plates 13 of the primary nozzle 1.

Figure 4A:
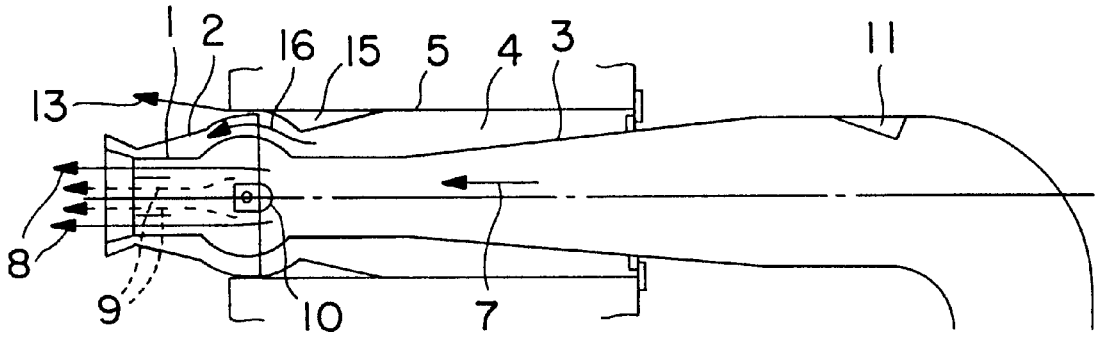
FIG. 4(*a*) is an explanatory diagram showing a case in which a mixed flow of a pulverized fuel and carrier air is injected horizontally; FIG.
Figure 4B:
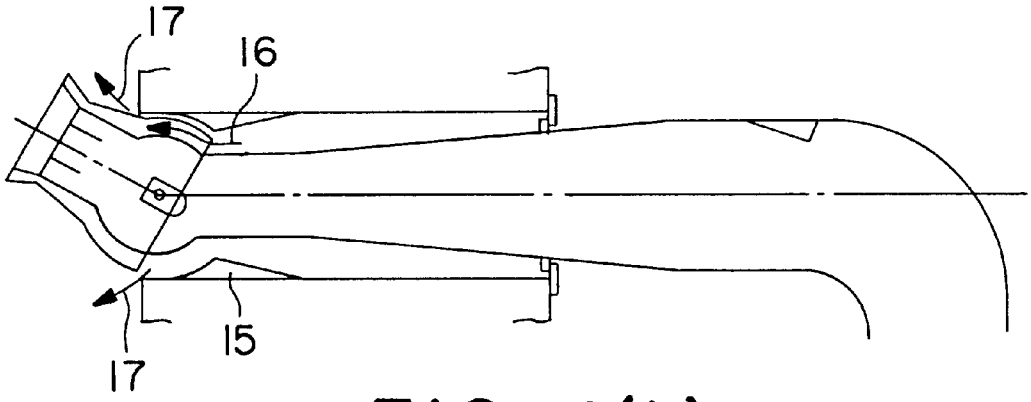
Figure 4C:
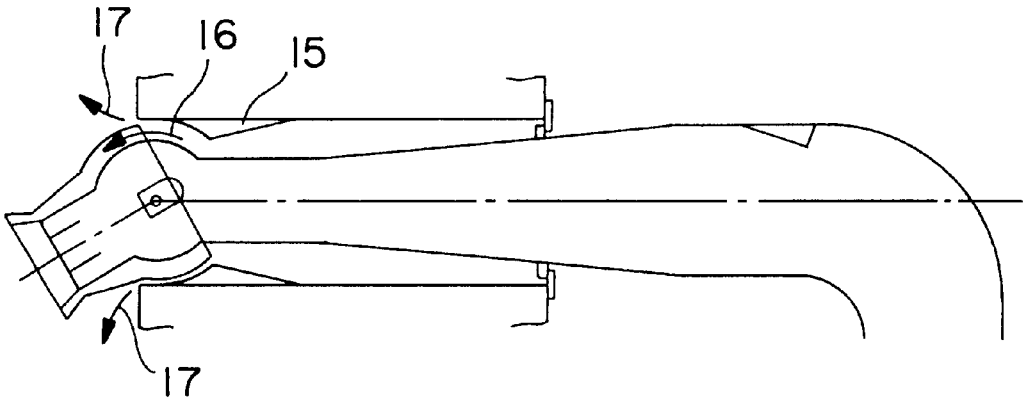
Figure 5A:
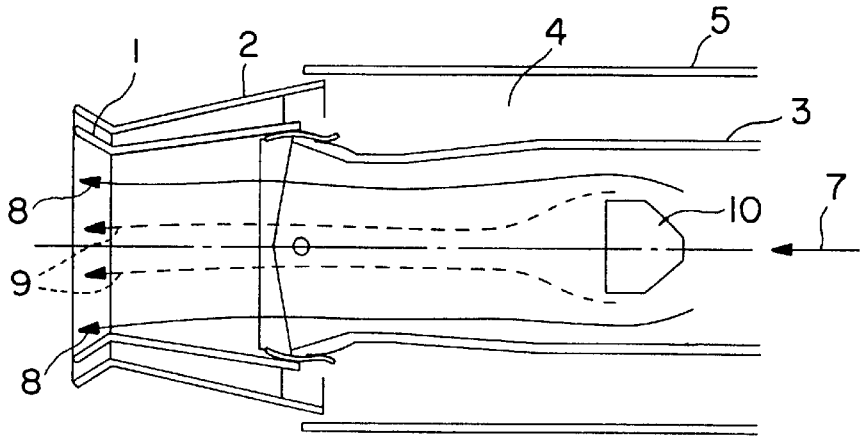
FIG. 5(a) PRIOR ART
FIG. 5(*a*) is an explanatory diagram showing a case in which a mixed flow of a pulverized fuel and carrier air is injected horizontally.
Figure 5B:
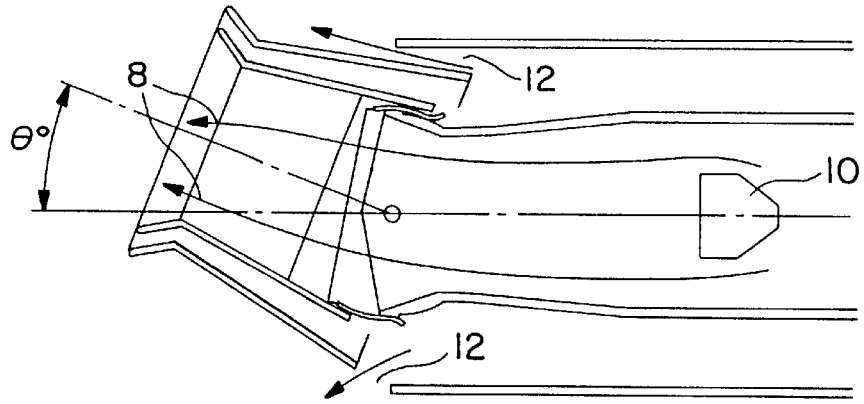
FIG. 5(b) PRIOR ART
Figure 5C:
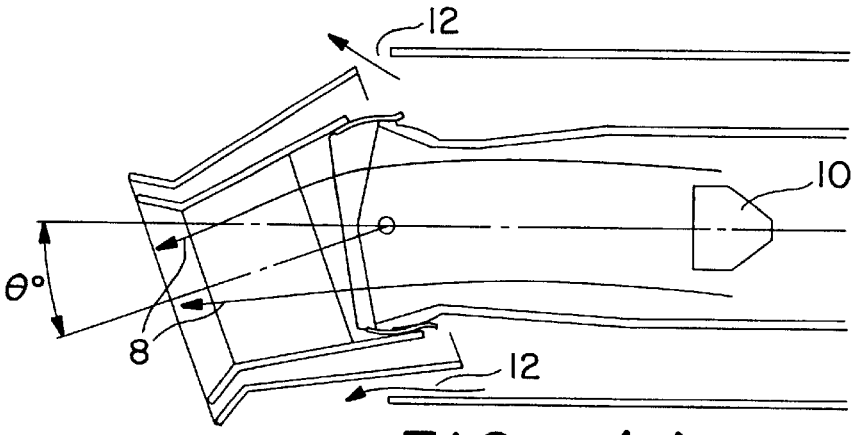
FIG. 5(c) PRIOR ART

Further, a fourth embodiment of the present invention will be described with reference to FIGS. 4(*a*) to 4(*c*). Like the first, second and third embodiments, FIGS. 4(*a*) to 4(*c*) are side sections showing a construction of a pulverized fuel combustion burner schematically. FIGS. 4(*a*), 4(*b*) and 4(*c*) show the cases, respectively, in which a mixed flow of a pulverized fuel and carrier air is injected horizontally, in which the mixed flow is injected upward, and in which the mixed flow is injected downward. Here, the portions identical to those of the prior art or the first, second and third embodiments are designated by common reference numerals, and overlapping description has been omitted.

In this embodiment, there is disposed, in the combustion auxiliary air supply passage 4, a combustion auxiliary air flow straightener 15 which is arranged inside of the windbox 5 and in the vicinity of a jointed portion between the secondary air nozzle 2 and the combustion auxiliary air supply passage 4. Reference numeral 16 designates the combustion auxiliary air to be injected from the combustion auxiliary air supply passage 4 through the secondary air nozzle 2 into the furnace. Numeral 17 designates the combustion auxiliary air which bypasses the secondary air nozzle 2 from the combustion auxiliary air supply passage 4 and leaks around the secondary-air nozzle 2 into the furnace.

In this embodiment, the mixed flow 7 of the pulverized fuel and the carrier air is dispersed by the dispersing device 11 and separated into the rich and lean flows by the rich/lean flow separator 10 until it is guided into the primary air nozzle 1.

The combustion auxiliary air flow straightener 15 acts to change the flow direction of the combustion auxiliary air so positively that the combustion auxiliary air, having passed the vicinities of the upper inner wall face and the lower inner wall face of the combustion auxiliary air supply passage 4, may pass through the inside of the secondary air nozzle 2.

As also shown in FIGS. 4(*b*) and 4(*c*), the combustion auxiliary air flow straightener 15 acts to change the flow direction of the combustion auxiliary air so positively that the combustion auxiliary air, having passed the vicinities of the upper inner wall face and the lower inner wall face of the combustion auxiliary air supply passage 4, may pass through the inside of the secondary air nozzle 2.

By the action of this combustion auxiliary air flow straightener 15, almost all of the combustion auxiliary air becomes the combustion auxiliary air 16 to be injected into the furnace through the secondary air nozzle 2, while minimizing the amount of the air 17 which might otherwise bypass the secondary air nozzle 2 and leak into the furnace.

Although the invention has been described in connection with the illustrated embodiments, it should not be limited thereto, and can naturally be variously modified in its specific structure within the scope thereof.

The pulverized fuel combustion burner according to the invention is constructed to comprise a plurality of air nozzles arranged on a side wall of a furnace for injecting a mixed flow of a pulverized fuel and carrier air to establish a flame. The burner includes a primary air nozzle having a variable direction to inject the mixed flow into the furnace, a secondary air nozzle for feeding combustion auxiliary air to around the primary air nozzle, a pulverized fuel supply pipe for feeding the mixed flow to said primary air nozzle and a windbox receiving said pulverized fuel supply pipe therethrough for forming a combustion auxiliary air supply passage around the pulverized fuel supply pipe. The windbox is constructed by arranging unit windboxes in a separated or jointed relation with respect to each other. Each unit windbox has at least one pulverized fuel supply pipe and one combustion auxiliary air supply passage. A rich/lean flow separator is disposed at or near a jointed portion between said primary air nozzle and said pulverized fuel supply pipe. The rich/lean flow separator is able to change its direction in response to or independently of a change in an injection direction of the primary air nozzle. As a result, the rich/lean flow separator varies following the change in the injection direction of the primary air nozzle so that the mixed flow can be injected as a reliable and stable flow without any biasing in the direction of the primary air nozzle from the primary air nozzle into the furnace, thereby providing a highly reliable pulverized fuel combustion burner.

The pulverized fuel combustion burner according to the invention to further comprises result, the flow separation is made at first by the rich/lean flow separator upstream. The mixed flow can be guided by taking over the separation effect without any biasing in the same direction as that of the primary air nozzle and injected into the furnace, thereby providing a highly reliable pulverized fuel combustion burner.

The pulverized fuel combustion burner according to the invention can also be constructed to comprise a plurality of air nozzles arranged on a side wall of a furnace for injecting a mixed flow of a pulverized fuel and carrier air to establish a flame. The air nozzles include a primary air nozzle having a variable direction to inject the mixed flow into the furnace, a secondary air nozzle for feeding combustion auxiliary air to around the primary air nozzle, a pulverized fuel supply pipe for feeding the mixed flow to the primary air nozzle and a windbox receiving pulverized fuel supply pipe therethrough for forming a combustion auxiliary air supply passage around the pulverized fuel supply pipe. The windbox is constructed by arranging the unit windboxes in a separated or jointed relation with respect to each other. Each unit windbox has at least one pulverized fuel supply pipe and one combustion auxiliary air supply passage. A rich/lean flow separator is disposed in the said pulverized fuel supply pipe and a flow straightener or a straightening plate is disposed in at least one of the primary air nozzle and the pulverized fuel supply pipe for maintaining a concentration distribution as established by the rich/lean flow separator to an exit of the primary air nozzle. As a result, the flow straightener or straightening plate takes the separation effect of the rich/lean separator so that the mixed flow of the pulverized fuel and the carrier air can be conveyed while being maintained separate in the rich flow and the lean flow and injected for preferable combustion from the primary air nozzle into the furnace, thereby enhancing the reliability of the pulverized fuel combustion burner.

The pulverized fuel combustion burner according to the invention can also be constructed to further comprise a combustion auxiliary air flow straightener disposed in the windbox for guiding the combustion auxiliary air into an entrance of the secondary air nozzle. As a result, the mixed flow of the pulverized fuel and the carrier air can be injected in a preferable situation from the primary air nozzle, and the combustion auxiliary air can be guided in a preferable state from the outer side into the entrance of the secondary air nozzle by the combustion auxiliary air flow straightener disposed in the windbox, thereby drastically preventing the leakage of the combustion auxiliary air at the entrance of the secondary air nozzle.

The pulverized fuel combustion burner according to the invention can also be constructed such that the primary air nozzle 1 is disposed at a corner portion of the side wall of the furnace. As a result, the burner is devised to separate the mixed flow of the pulverized fuel and the carrier air into-the rich flow and the lean flow with the pulverized fuel supply pipe and the primary air nozzle and to maintain the separation effect, and is arranged at the corner portion of the furnace side wall so that a preferable injection can be effected from the corner portion into the furnace, thereby attaining proper combustion.

The pulverized fuel combustion burner according to the invention can also be constructed such that the windbox comprises a plurality of unit windboxes. Each has a square front section and each at least one pulverized fuel supply pipe and one combustion auxiliary air supply passage. The unit windboxes are arranged in a separated or jointed relation with respect to each other. As a result, the unit windbox is constructed by housing the primary air nozzle, which is devised to separate the mixed flow of the pulverized fuel and the carrier air by the pulverized fuel supply pipe and the primary air nozzle and to maintain the separation effect, and the secondary air nozzle which prevents the leakage of the combustion auxiliary air at its entrance. The unit windbox has an upward and downward directional length of one and a half (1.5) times or less of its lateral directional length, so that the entire construction can be made compact without lowering the performance.

We claim:

1. A pulverized fuel combustion burner arrangement for a furnace comprising:

a primary air nozzle having a variable direction to inject a mixed flow of pulverized fuel and carrier air into the furnace;

a secondary air nozzle for feeding combustion auxiliary air to around said primary air nozzle;

a pulverized fuel supply pipe for feeding the mixed flow to said primary air nozzle;

a windbox forming a combustion auxiliary air supply passage around said pulverized fuel supply pipe;

a jointed portion between said primary air nozzle and said pulverized fuel supply pipe so as to allow said primary nozzle to change direction relative to said pulverized fuel supply pipe;

a rich/lean flow separator disposed and arranged at or near said jointed portion in a central position in said pulverized fuel supply pipe so as to separate, or maintain separation of, the mixed flow as a relatively rich outer flow surrounding a relative lean inner flow and structured either such that said rich/lean flow separator can change direction in response to a change in direction of said primary air nozzle relative to said pulverized fuel supply pipe or such that said rich/lean flow separator can change direction independently of a change in direction of said primary air nozzle relative to said pulverized fuel supply pipe; and an upstream rich/lean flow separator disposed upstream of said rich/lean flow separator in said pulverized fuel supply pipe;

wherein said upstream rich/lean flow separator is disposed in a middle portion of said pulverized fuel supply pipe such that said upstream rich/lean flow separator is spaced from opposite inner walls of said pulverized fuel supply pipe and such that when the mixed flow flows around said rich/lean flow separator, a rich/lean flow concentration distribution is established in which a fuel-rich flow is created at an outer part inside of said pulverized fuel supply pipe and adjacent to said opposite inner walls and a fuel-lean flow is created at an inner part of said pulverized fuel supply pipe inside of the rich flow and along a center line of said pulverized fuel supply pipe.

2. The pulverized fuel combustion burner arrangement for a furnace as set forth in claim 1, wherein said rich/lean flow separator is disposed in a central position of said pulverized fuel supply pipe such that said rich/lean flow separator is spaced from opposite inner walls and such that when the mixed flow flows around said rich/lean flow separator, the rich/lean flow concentration distribution from said upstream rich/lean flow separator is maintained such that the fuel-rich flow is at an outer part inside of said primary air nozzle and the fuel-lean flow is at an inner part of said primary air nozzle inside of of the rich flow and along a center line of said primary air nozzle.

* * * * *